US005814930A

United States Patent [19]

Watanabe et al.

[11] Patent Number: 5,814,930

[45] Date of Patent: Sep. 29, 1998

[54] COLOR CATHODE RAY TUBE

[75] Inventors: Kenichi Watanabe, Ohtaki; Syoji Shirai, Mobara; Shinichi Kato, Mobara; Akiyoshi Tobe, Mobara, all of Japan

[73] Assignee: Hitachi, Ltd., Tokyo, Japan

[21] Appl. No.: 863,337

[22] Filed: May 27, 1997

[30] Foreign Application Priority Data

Jun. 11, 1996 [JP] Japan ..... 8-149193

[51] Int. Cl.[6] ..... H01J 29/46

[52] U.S. Cl. ..... 313/414; 313/449

[58] Field of Search ..... 313/412, 413, 313/414, 446, 447, 449

[56] References Cited

U.S. PATENT DOCUMENTS

| | | | |
|---|---|---|---|
| 3,852,608 | 12/1974 | Johanns et al. | 313/459 |
| 4,399,388 | 8/1983 | Hamano et al. | 313/414 |
| 5,223,764 | 6/1993 | Chen | 313/414 |
| 5,621,286 | 4/1997 | Toujou et al. | 313/414 |

FOREIGN PATENT DOCUMENTS

| | | |
|---|---|---|
| 53-18866 | 6/1978 | Japan . |
| 7005233 | 10/1971 | Netherlands . |

*Primary Examiner*—Nimeshkumar Patel

*Attorney, Agent, or Firm*—Antontelli, Terry, Stout & Kraus, LLP

[57] ABSTRACT

A color cathode ray tube having an in-line type electron gun includes an electron beam generating means having a plurality of electrodes and including at least a cathode for producing electron beams, a first electrode and a second electrode, both constituting control electrodes and arranged in that order, and a heater for heating the cathode; a third electrode, a fourth electrode and a fifth electrode, together constituting a first-stage focusing lens for focusing the three electron beams onto the phosphor screen; and a fifth electrode and a sixth electrode, both forming a second stage focusing lens. Electrical connections are made between the second electrode and the fourth electrode and between the third electrode and the fifth electrode. The first electrode has an aperture 0.45 mm or smaller in diameter, and the relation between a ratio A of the second electrode length to the second electrode aperture diameter and a ratio B of the fourth electrode length to the fourth electrode aperture diameter is so set as to satisfy all four expressions: $40A+88B-57 \geqq 0$, $100A-260B-22 \geqq 0$, $100A+176B-112 \geqq 0$ and $B-0.125 \geqq 0$.

12 Claims, 10 Drawing Sheets

COLOR CATHODE RAY TUBE

BACKGROUND OF THE INVENTION

The present invention relates to a color cathode ray tube having an in-line type electron gun which radiates three electron beams side by side in the same horizontal plane toward a phosphor screen.

Color cathode ray tubes used as TV picture tubes and monitor tubes at information terminals incorporate at one end of a vacuum vessel an electron gun that emits a plurality of electron beams (generally three beams for red, green and blue), have on the inner side of the other end of the vacuum vessel a phosphor screen coated with a phosphor film of two or more colors (generally the three colors of red, green and blue) and a shadow mask, operating as a color selection electrode, installed close to the phosphor screen, and perform a two-dimensional scan of these electron beams emitted from the electron gun by using a magnetic field produced by a deflection yoke mounted on the outside of the vacuum vessel to display a desired image.

FIG. 1 is a cross section showing an example of the structure of the typical color cathode ray tube. In FIG. 1, the tube includes a panel portion 21, a funnel portion 22, a neck portion 23, a phosphor film 24, a shadow mask 25, a mask frame 26, an inner magnetic shield 27, a shadow mask support mechanism 28, an in-line type electron gun 29, a deflection yoke 30, a beam adjustment device 31, an internal conductive coating 32, a tension band 33, a stem pin 34, and a getter 35.

This color cathode ray tube has a vacuum vessel comprising the panel portion 21, the neck portion 23, and the funnel portion 22 connecting the panel portion 21 and neck portion 23.

The color cathode ray tube has on the inner surface of the panel portion 21 a display screen (hereinafter referred to simply as a screen) formed of a phosphor film 24 coated with phosphors of three colors, R, G, B. The electron gun 29, which emits three electron beams in-line, is installed in the neck portion 23. The shadow mask 25 having a number of apertures or a parallel array of narrow strips is arranged close to the phosphor film 24 on the panel portion 21.

In FIG. 1, reference symbols Bc, Bs represent center and side electron beams, respectively. The deflection yoke 30 is mounted in a transitional region between the funnel portion 22 and the neck portion 23.

The getter 35 is supported on the front end of a getter support spring which is secured at the other end to a shield cup arranged at the front end of the electron gun 29.

The three electron beams emitted from the electron gun 29 are deflected in two orthogonal directions. horizontal and vertical, by vertical and horizontal deflection magnetic fields generated by the deflection yoke 30, and, as they pass through electron beam passing openings of the shadow mask 25, they are color-selected before impinging on the R,G and B phosphors to produce a color image on the phosphor film 24.

FIG. 2 is a vertical cross section showing the construction of the conventional in-line type electron gun. In FIG. 2, the electron gun includes a cathode 1, a heater 1*a*, a first electrode (G1 electrode) 2, a second electrode (G2 electrode) 3, a third electrode (G3 electrode) 4, a fourth electrode (G4 electrode) 5, a fifth electrode (G5 electrode) 6, and a sixth electrode (G6 electrode) 7. In FIG. 2, an aperture 8 is provided in the first electrode (G1 electrode aperture), an aperture 9 is provided in the second electrode (G2 electrode aperture), a second electrode side aperture 10 is provided in the third electrode (G3 electrode aperture on the G2 electrode side), a fourth electrode side aperture 11 is provided in the third electrode (G3 electrode aperture on the G4 electrode side), a third electrode side aperture 12 is provided in the fourth electrode (G4 electrode aperture on the G3 electrode side), a fifth electrode side aperture 12' is provided in the fourth electrode (G4 electrode aperture on the G5 electrode side), a fourth electrode side aperture 13 is provided in the fifth electrode (G5 electrode aperture on the G4 electrode side), a sixth electrode side aperture 14 is provided in the fifth electrode (G5 electrode aperture on the G6 electrode side), and an aperture 15 is provided in the sixth electrode (G6 electrode aperture).

In FIG. 2, the electron producing cathode 1, and the G1 electrode 2 and G2 electrode 3 which are control electrodes, together form a triode unit that generates electron beams. The G3 electrode 4, the G4 electrode 5 and the G5 electrode 6 together form a sub-main lens. The G5 electrode 6 and the G6 electrode 7 together form a main lens. The three electron beams are focused on the phosphor screen by the sub-main lens and the main lens. In FIG. 2, there are electrical connections between the G2 electrode 3 and G4 electrode 5, and between the G3 electrode 4 and G5 electrode 6.

The G1 electrode aperture 8 and the G2 electrode aperture 9 are 0.4 to 0.6 mm in diameter in FIG. 2; the G2 electrode 3 has a length in the tube axis direction of about 0.3 mm at the aperture 9; the G3 electrode aperture on the G4 electrode side 11, the G4 electrode aperture on the G3 electrode side 12 and the G5 electrode aperture on the G4 electrode side 13 are about 4.0 mm in diameter; and the G4 electrode and the G5 electrode have the lengths in the tube axis direction of 0.5 to 1.5 mm and 27 mm, respectively.

The in-line type electron gun operates as follows.

Thermoelectrons (not shown) released from the cathode 1 heated by the heater 1*a* are attracted toward the G1 electrode 2 side by a positive voltage (Ec2) of 400 to 1000 V applied to the G2 electrode 3 to form three electron beams (not shown). These three electron beams are focused to a cross over point by the cathode lens formed between the G1 electrode 2 and the G2 electrode 3 and then the beams diverge. These three electron beams pass through the electron beam passing opening of the G1 electrode 2 (G1 electrode aperture 8) and the electron beam passing opening of the G2 electrode 3 (G2 electrode aperture 9) and are slightly focused by the pre-focus lens formed between the G2 electrode 3 and the G3 electrode 4 and the sub-main lens formed between the G3 electrode 4 and the G4 electrode 5 and between the G4 electrode 5 and the G5 electrode 6, which comprises the G3 electrode 4 to which there is applied a low voltage (focus voltage Vf) of about 5 to 10 kV, the G4 electrode 5 to which there is applied the same voltage as the G2 electrode 3, and the G5 electrode 6 to which there is applied with the same voltage as the G3 electrode 4. Next, the beams are accelerated by the positive voltage (Vf) applied to the G) electrode and enter into the main lens formed between the G5 electrode 6 and the G6 electrode 7.

Between the G5 electrode 6 and the G6 electrode 7 an electrostatic field is formed by a potential difference between the G5 electrode 6 making up the main lens and the G6 electrode 7 to which a high voltage (Eb) of about 20 to 35 kV is applied. The three electron beams entering into the main lens are bent in their trajectories by the electrostatic field and thereby focused on the phosphor screen to form a beam spot on the screen.

Measures to prevent degradation of the beam spot focusing at peripheral portions of the screen include providing the G2 electrode 3 with a laterally (or horizontally) elongate rectangular recess at the aperture 9 on the G3 electrode side, as disclosed in Japanese Patent Publication No. 18866/1978.

To improve the resolution of an image formed on the screen in the color cathode ray tube using an in-line type electron gun of the above configuration, the diameter of a beam spot on the screen must be reduced.

The beam spot diameter on the screen depends largely on the current of the electron beam emitted from the cathode. That is, as the current of the electron beam increases, i.e., as the luminance of the display screen increases, the repulsion among the electrons in the beam being focused becomes stronger, and the beam diameter at the main lens becomes larger, and the beam diameter at the cross over point becomes larger according to the increase in the aberration of the cathode lens and prefocus lens, thereby increasing the diameter of the beam spot on the screen and degrading the resolution of the display image. Hence, the degradation of resolution of the display image becomes critical in the medium to maximum luminance range, the practical usage area for the display image. In a color display tube of a 51 cm effective diagonal screen size (equivalent to a 21 inch color display tube), for example, the current value (cathode current Ik) for one cathode is high at around 300 to 500 $\mu$A for the display of medium to high luminance images. It is therefore essential to reduce the beam spot diameter on the screen at least in this range of the cathode current.

In reducing the beam spot diameter on the screen by improving the focusing characteristic of the electron gun, it is effective to reduce the diameters of the electron beam passing openings (8, 9) of the G1 electrode 2 and the G2 electrode, to reduce the crossover point diameter of the electron beam projected by the main lens onto the phosphor screen and to thereby increase the current density of the beam spot on the screen.

SUMMARY OF THE INVENTION

In a color cathode ray tube having an in-line type electron gun of the above construction, simply reducing the spot diameter in the medium to high luminance range has a problem in that moire may occur in the low luminance display where the spot diameter is smaller than in the medium-to-high luminance display, i.e., in the display at a lower limit contrast for recognizing an image.

The moire is a phenomenon in which a fringe pattern is produced on the screen by interference between the periodically structured phosphor dots and the electron beam scan lines or periodic video signals when the beam spot diameter on the screen becomes smaller than a certain value, thereby degrading the resolution. The former interference is referred to as raster moire or horizontal moire, and the latter as video moire or vertical moire.

The cathode current (Ik) for the low luminance image display is small at around 100 $\mu$A. Moire is produced by reducing the spot diameter for the medium to high luminance display or the high current range display, because in the low current range where the repulsion among electrons in the beam is weak, the spot diameter is further reduced.

In a color cathode ray tube having an in-line type electron gun of the above configuration, as described in the prior art, if the G2 electrode aperture on the G3 electrode side is not provided with a horizontally elongate rectangular recess, as is proposed in Japanese Patent Publication No. 18866/1978, the electron beam is strongly influenced by aberration due to deflection, resulting in beam spots at the peripheral portions of the screen being extended horizontally and shortened vertically, which in turn causes raster moire.

To prevent the occurrence of raster moire, the color cathode ray tube disclosed in Japanese Patent Publication No. 18866/1978 gives a large astigmatism to the electron beam by forming a horizontally elongate rectangular recess at the G2 electrode aperture on the G3 electrode side to deform the beam spot on the screen to be vertically elongate, thereby canceling the deflection aberration and increasing the vertical direction diameter to suppress raster moire. This color cathode ray tube, however, because it reduces the horizontal direction diameter of the beam spot, causes vertical moire instead of raster moire. If the beam spot diameter is reduced in the high current range to improve the resolution of the medium to a high luminance range display image, the beam spot diameter is further reduced in the small current range, making this method disadvantageous as a preventive measure for moire in the low current range.

An object of this invention is to provide a color cathode ray tube having an in-line type electron gun, which eliminates the above problems experienced with the prior art and which satisfies both requirements of improving the focusing characteristic in a high current range and suppressing moire in a low current range.

In a color cathode ray tube including an in-line type electron gun of the above configuration, the beam spot diameter needs to be somewhat small to increase the resolution of an image for a medium to high luminance image display, i.e., in a high cathode current range. For a low luminance image display, i.e., in a small cathode current range, the beam spot diameter needs to be sufficiently large so as not to cause moire in the display image.

To meet these requirements, this invention sets the diameter of the G1 electrode aperture at 0.45 mm or less, and sets in a predetermined range the relation between a ratio A of the G2 electrode length in the tube axis direction to the G2 electrode aperture diameter and a ratio B of the G4 electrode length in the tube axis direction to the G4 electrode aperture diameter.

In other words, a color cathode ray tube having an in-line type electron gun comprises: an electron beam generating means including at least a cathode for producing three electron beams, i.e., the red, green and blue beams, directed toward a phosphor screen, a G1 electrode and a G2 electrode, both constituting control electrodes and arranged in that order, and a heater for heating the cathode; a G3 electrode, a G4 electrode and a G5 electrode, together constituting a first stage focusing lens for focusing the three electron beams onto the phosphor screen; and a G5 electrode and a G6 electrode, both forming a second stage focusing lens (main lens); wherein electrical connections are made between the G2 electrode and the G4 electrode and between the G3 electrode and the G5 electrode; wherein the G1 electrode has an aperture 0.45 mm or smaller in diameter and the relation between a ratio A of the G2 electrode length in the tube axis direction to the G2 electrode aperture diameter and a ratio B of the G4 electrode length in the tube axis direction to the G4 electrode aperture diameter is in a region enclosed by four lines represented by $$40A+88B-57=0$$

$$100A-260B-22=0$$

$$100A+176B-112=0$$

$$B-0.125=0.$$

In this invention, the diameter of the G1 electrode aperture is the diameter of a circle inscribed in the electron beam passing opening formed in the G1 electrode plate. For example, if the electron beam passing opening is an oval, the diameter is represented by the length of a minor axis of the oval; if it is a square, the diameter is represented by one of its sides; if it is a rectangle, the diameter is represented by a shorter side.

The diameter of the G2 electrode aperture is the diameter of a circle inscribed in the electron beam passing opening formed in the G2 electrode plate. When the electron beam passing opening formed in the G2 electrode plate changes its shape between the G1 electrode side and the G3 electrode side, the diameter in question is represented by the diameter of the smallest of the circles inscribed in the electron beam passing opening.

The G2 electrode length in the tube axis direction represents a distance measured along the tube axis between a surface of the G2 electrode facing the G1 electrode and a surface of the G2 electrode facing the G3 electrode.

The G4 electrode length in the tube axis direction represents a distance measured along the tube axis between a surface of the G4 electrode facing the G3 electrode and a surface of the G4 electrode facing the G5 electrode.

The G4 electrode aperture diameter is the diameter of a circle inscribed in the electron beam passing opening formed in the G4 electrode. When the electron beam passing opening formed in the G4 electrode plate changes its shape between the G3 electrode side and the G5 electrode side. the diameter in question is represented by the diameter of the smallest such circle.

In addition to the above configuration, the color cathode ray tube of this invention has the main lens of the electron gun formed between two cylindrical electrodes with different potentials. These cylindrical electrodes together form a single common path for the three in-line electron beams. These cylindrical electrodes are oval in cross section in a plane perpendicular to the tube axis and contain therein plate-like electrodes having electron beam passing openings. The plate-like electrodes with the electron beam passing openings have a thickness in the tube axis direction.

Further, the color cathode ray tube of this invention has the G5 electrode of the electron gun divided into a plurality of parts, to one of which is applied a dynamic focus voltage synchronous with the current flowing in the deflection yoke.

In the color cathode ray tube of this invention, the G1 electrode has an aperture which is 0.45 mm or less in diameter through which at least a green electron beam with a high luminosity factor passes, and the relation between a ratio A of the G2 electrode length in the tube axis direction to the diameter of a G2 electrode aperture for the green electron beam and a ratio B of the G4 electrode length in the tube axis direction to the diameter of a G4 electrode aperture for the green electron beam is in a region enclosed by four lines represented by $$40A+88B-57=0$$

$$100A-260B-22=0$$

$$100A+176B-112=0$$

$$B-0.125=0.$$

With this configuration, it is possible to meet both requirements of improving the focusing characteristic in the high current range and suppressing moire in the low current range, thus providing high quality images over the entire area of the screen in the full current range of the electron beams.

As described above, the color cathode ray tube having an in-line type electron gun according to this invention comprises: an electron beam generating means including at least a cathode for producing three electron beams, a G1 electrode and a G2 electrode, both constituting control electrodes and arranged in that order, and a heater for heating the cathode; a G3 electrode, a G4 electrode and a G5 electrode, together constituting a sub-main lens for focusing the three electron beams onto the phosphor screen; and a G5 electrode and a G6 electrode, both forming a main lens; wherein electrical connections are made between the G2 electrode and the G4 electrode and between the G3 electrode and the G5 electrode; wherein the G1 electrode has an aperture of 0.45 mm or smaller in diameter and the relation between a ratio A of the G2 electrode length in the tube axis direction to the G2 electrode aperture diameter and a ratio B of the G4 electrode length in the tube axis direction to the G4 electrode aperture diameter is set in a predetermined range. This configuration makes it possible to manufacture electrode parts with ease, improve the focusing characteristic in a high current range and at the same time suppress moire in a low current range, thus assuring high quality images with high resolution over the entire area of the screen.

DETAILED DESCRIPTION OF THE PREFERRED EMBODIMENTS

Figure 1:
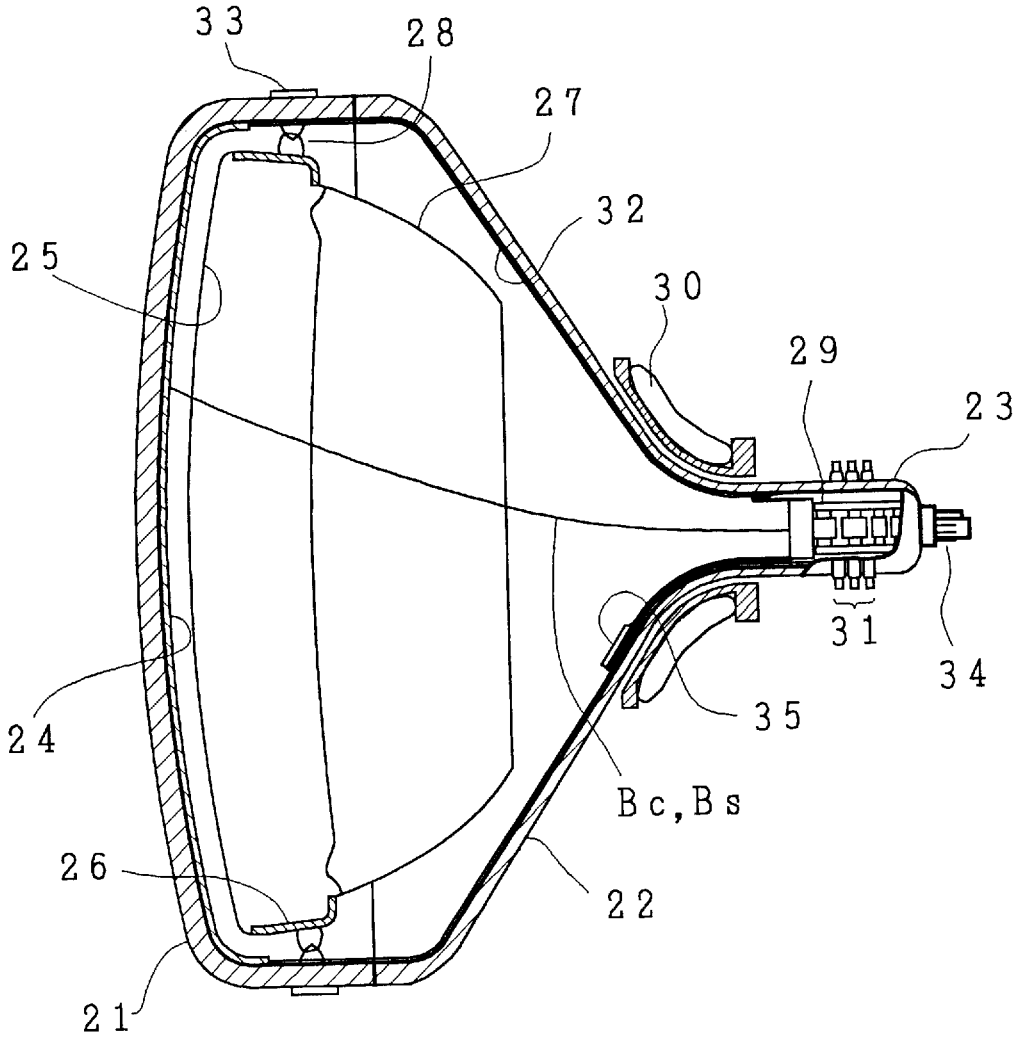
FIG. 1 is a cross section of a color cathode ray tube taken along its axis showing an example structure of the color cathode ray tube that applies the present invention.
Figure 2:
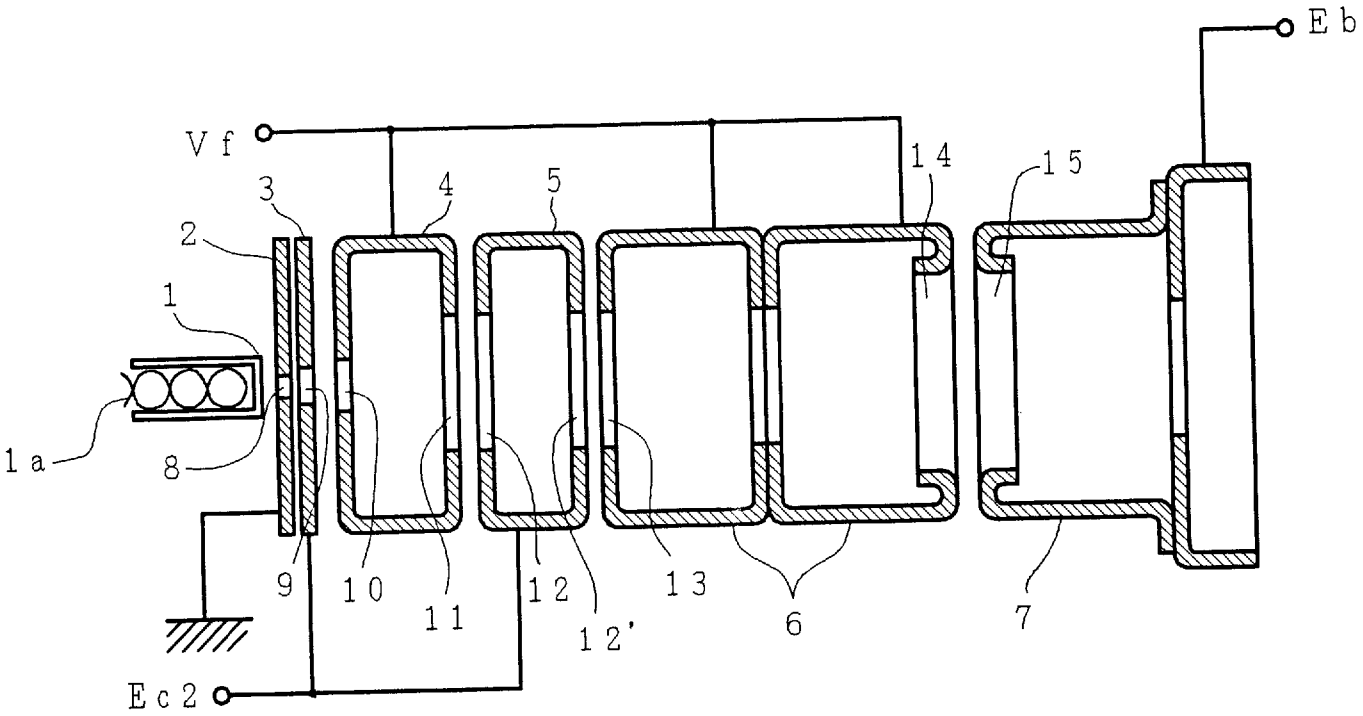
FIG. 2 is a cross section along the tube axis showing the outline structure of a conventional in-line type electron gun.
Figure 3:
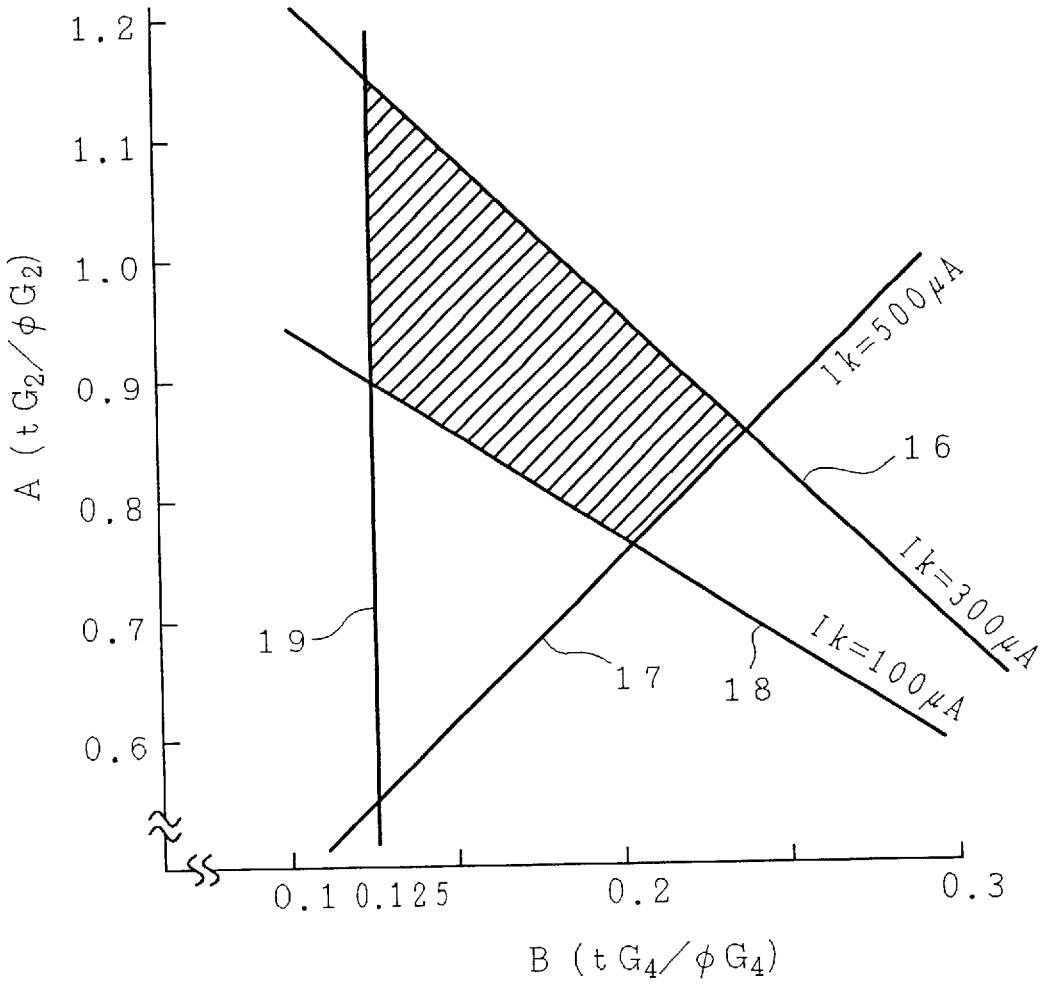
FIG. 3 is a graph showing the relation between a ratio A of the G2 electrode length along tube axis to the G2 electrode aperture diameter and a ratio B of the G4 electrode length along tube axis to the G4 electrode aperture diameter.

FIG. 3 shows the relation between the ratio of the G2 electrode length to the G2 aperture diameter and the ratio of the G4 electrode length to the sub-main lens diameter, the G2 and G4 electrodes making up the in-line type electron gun. In FIG. 3, the ordinate represents the ratio A of the G2 electrode length in the tube axis direction (tG2) to the G2 electrode aperture diameter (øG2), where $$A=tG2/øG2$$

The abscissa represents the ratio B of the G4 electrode length in the tube axis direction (tG4) to the G4 electrode aperture diameter (øG4), where $$B=tG4/øG4$$

In a color display tube (CDT) with a 51 cm effective diagonal screen size and a shadow mask pitch of 0.31 to 0.26 mm, moire is not observed if the beam spot diameter on the screen is 0.45 mm or greater. That is, to keep moire from occurring requires the spot diameter at the center of the screen to be 0.45 mm or larger for a low current.

By calculating the modulation transfer function (MTF) for the above mask pitch, the on-screen beam spot diameter that provides the resolution response of 0.2 for an ultra fine display of 1600 dots/line×1200 lines (about 1.9M pixels) is determined to be 0.60 mm. Hence to obtain a good resolution in the practical usage area, the spot diameter needs to be 0.6 mm or less.

By calculating the MTF for the above mask pitch, the on-screen beam spot diameter that offers the resolution response of 0.2 for the ordinary display of 1280 dots/line× 1024 lines (about 1.3M pixels) is determined to be 0.73 mm. Thus, it is necessary to keep the beam spot diameter to less than 0.73 mm even when a maximum current flows through the cathode.

The on-screen beam spot diameter varies depending on the beam diameter entering the main lens of the electron gun. To keep the spot diameter small for a large current requires the beam diameter entering the main lens to be set larger than a certain diameter.

As the ratio A of the G2 electrode length in the tube axis direction to the G2 electrode aperture diameter decreases and the ratio B of the G4 electrode length in the tube axis direction to the G4 electrode aperture diameter (diameter of the sub-main lens) decreases, the electron beam diameter entering the main lens increases, reducing the beam spot diameter on the screen.

Our experiments have found that the relation between the ratio A and the ratio B that offers a beam spot diameter of 0.6 mm or smaller for large currents (Ik=300 $\mu$A) lies in the area below the line 16 of FIG. 3 that satisfies the following inequality $$40A+88B-57 \leqq 0$$

where A is the ratio of the G2 electrode length in the tube axis direction of tG2 mm to the G2 electrode aperture diameter of øG2 mm and B is the ratio of the G4 electrode length in the tube axis direction of tG4 mm to the G4 electrode aperture diameter (diameter of the sub-main lens) of øG4 mm.

To maintain the resolution response of 0.2 at the above MTF for Ik=500 $\mu$A, the maximum allowable current in the monitor set using this color CDT, the on-screen spot diameter must be kept at 0.73 mm or smaller.

From experiments, it has been found that the relation between the ratio A and the ratio B that offers a spot diameter of 0.73 mm or smaller for Ik=500 $\mu$A lies in the area above the line 17 of FIG. 3 that satisfies the following inequality $$100A-260B-22 \geqq 0$$

where A is the ratio of the G2 electrode length in the tube axis direction of tG2 mm to the G2 electrode aperture diameter of øG2 mm and B is the ratio of the G4 electrode length in the tube axis direction of tG4 mm to the G4 electrode aperture diameter (diameter of the sub-main lens) of øG4 mm. This inequality means the following. Under the high beam current condition, to reduce the aberrations of the cathode lens and the pre-focus lens, the ratio A must be increased. But the beam diameter at the main lens decreases by increasing the ratio A, so that the ratio B must be reduced to increase the beam diameter at the main lens.

It is also necessary to set the spot diameter of low currents to 0.45 mm or larger. In this case, the spot diameter can be increased by reducing the electron beam diameter entering the main lens.

Hence, the beam spot diameter can be increased either by increasing the ratio A of the G2 electrode length in the tube axis direction to the G2 electrode aperture diameter or by increasing the ratio B of the G4 electrode length in the tube axis direction to the G4 electrode aperture diameter.

From our experiments it is determined that the relation between the ratio A and the ratio B that offers a spot diameter of 0.45 mm or larger for low currents lies in the area above the line 18 of FIG. 3 that meets the condition of the following inequality $$100A+176B-112 \geqq 0$$

where A is the ratio of the G2 electrode length in the tube axis direction of tG2 mm to the G2 electrode aperture diameter of øG2 mm and B is the ratio of the G4 electrode length in the tube axis direction of tG4 mm to the G4 electrode aperture diameter (diameter of the sub-main lens) of øG4 mm.

When the ratio B of the G4 electrode length in the tube axis direction to the G4 electrode aperture diameter decreases, the G4 electrode length in the tube axis direction decreases relative to the G4 electrode aperture diameter. When the G4 electrode length decreases, the mechanical strength of the electrode decreases. When the G4 electrode aperture diameter increases, the remaining portion (bridge) of the electrode plate between the electron beam passing openings becomes narrow, weakening the mechanical strength of the electrode, too.

Our experiments have shown that when the ratio B of the G4 electrode length in the tube axis direction to the G4 electrode aperture diameter (diameter of the sub-main lens) is less than 0.125, the mechanical strength of the electrode becomes small, resulting in a frequent problem of electrode deformation during the assembly of the electron gun. making the parts assembly difficult.

Thus, the ratio B of the G4 electrode length in the tube axis direction to the G4 electrode aperture diameter (diameter of the sub-main lens) needs to be set as follows:

$$B \geqq 0.125$$

This relation is represented by the line 19 in FIG. 3.

The relation between the ratio A of the G2 electrode length in the tube axis direction to the G2 electrode aperture diameter and the ratio B of the G4 electrode length in the tube axis direction to the G4 electrode aperture diameter (diameter of the sub-main lens), which satisfies the above three conditions simultaneously is represented by the shaded area in FIG. 3.

By setting in the shaded area of FIG. 3 the relation between the ratio A of the G2 electrode length in the tube axis direction to the G2 electrode aperture diameter and the ratio B of the G4 electrode length in the tube axis direction to the G4 electrode aperture diameter (diameter of the sub-main lens) as mentioned above, it is possible to satisfy both requirements of offering the desired focusing characteristic and suppressing moire without deforming the electrodes during the electron gun assembly.

Figure 4:
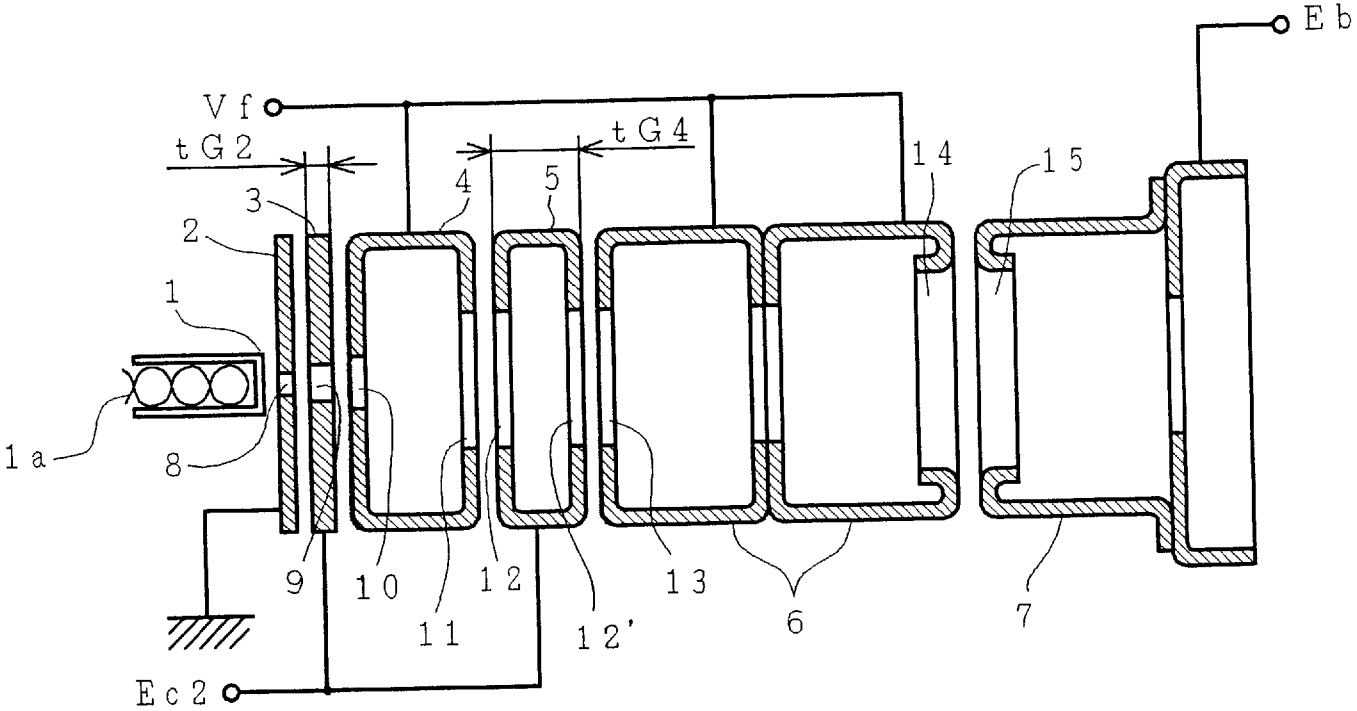
FIG. 4 is a schematic cross section showing the outline construction of an in-line type electron gun used in the color cathode ray tube as one embodiment of this invention.

FIG. 4 shows a schematic cross section of the in-line type electron gun used in the color cathode ray tube of this invention. In FIG. 4, there is shown a cathode 1, a G1 electrode 2, a G2 electrode 3, a G3 electrode 4, a G4 electrode 5, a G5 electrode 6, a G6 electrode 7, a G1 electrode aperture 8, a G2 electrode aperture 9, a G3 electrode aperture 10 on the G2 electrode side, a G3 electrode aperture 11 on the G4 electrode side, a G4 electrode aperture 12 on the G3 electrode side, a G4 electrode aperture 12' on the G5 electrode side, a G5 electrode aperture 13 on the G4 electrode side, a G5 electrode aperture 14 on the G6 electrode side, and a G6 electrode aperture 15.

Figure 5A:
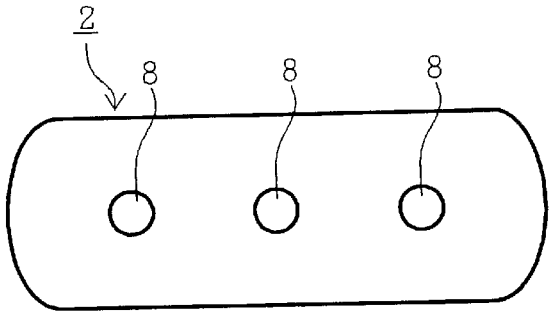
FIGS. 5*a* to 5*e* are schematic front views of the G1 electrode of the in-line type electron gun of the color cathode ray tube of this invention.
Figure 5B:
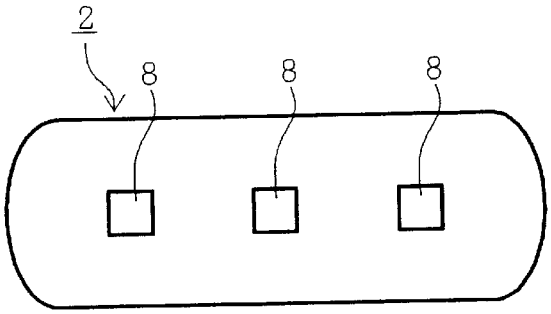
Figure 5C:
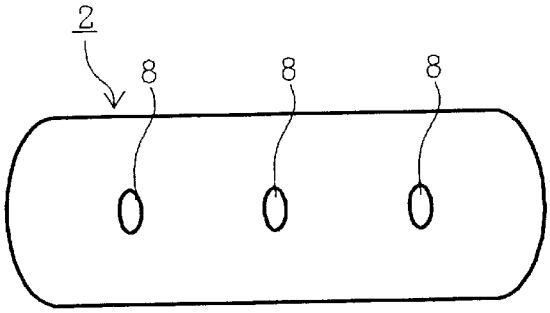
Figure 5D:
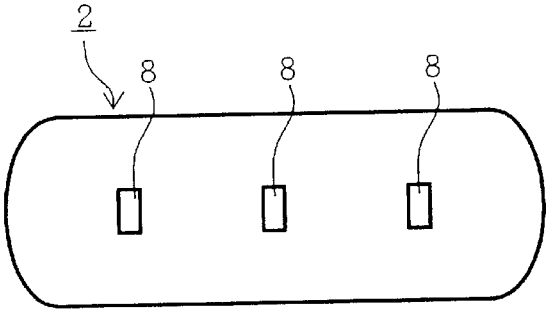
Figure 5E:
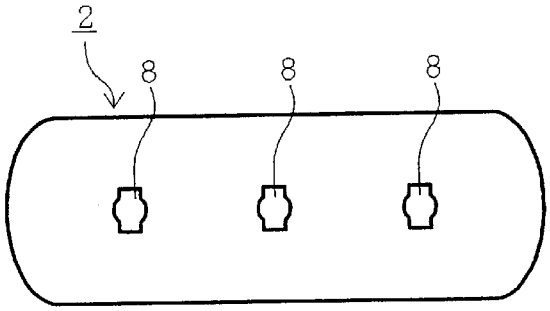

FIGS. 5*a* to 5*e* show front views of the G1 electrode 2 that can be applied to the electron gun of FIG. 4. The shape of the G1 electrode apertures 8 may be a circle, square or oval, or a combination of these. The three electron beam apertures 8 in the G1 electrode 2 may all have the same shape or the center beam aperture and the side beam apertures may be differentiated in shape. When the G1 electrode apertures 8 are shaped as a rectangle, oval or a combination of these, it is preferred that they be vertically elongate as shown in FIGS. 5*c* to 5*e*.

Figure 6A:
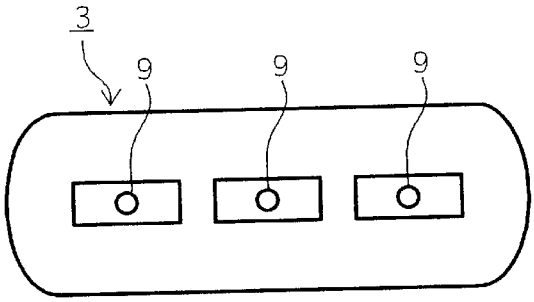
FIGS. 6*a* to 6*e* are schematic rear views of the G2 electrode of the in-line type electron gun of the color cathode ray tube of this invention as seen from the G1 electrode side.
Figure 6B:
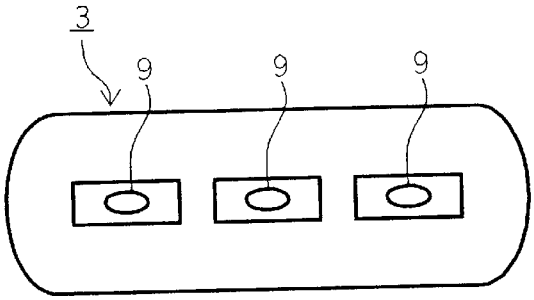
Figure 6C:
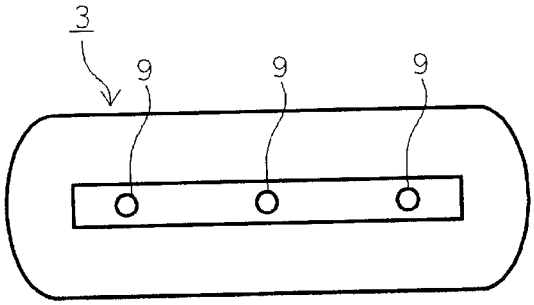
Figure 6D:
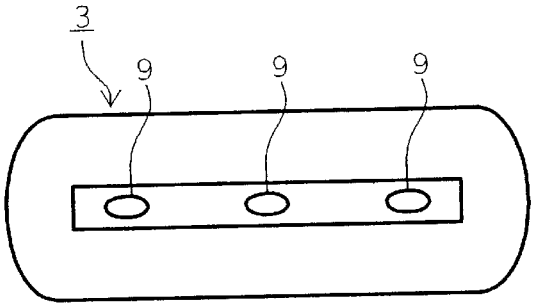
Figure 6E:
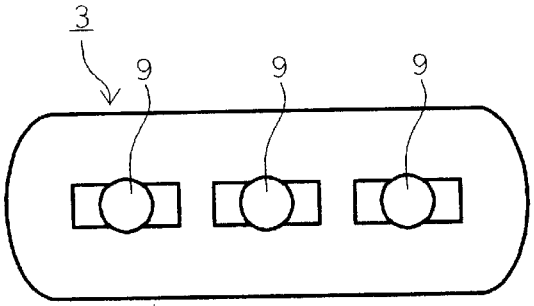
Figure 6F:
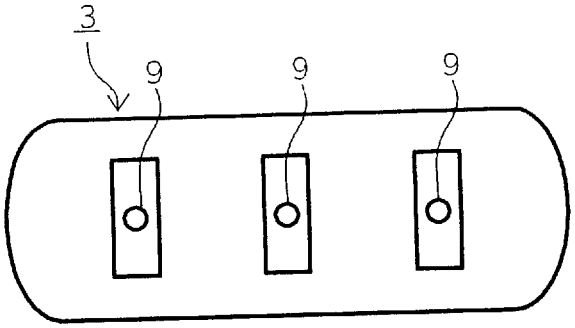
FIGS. 6*f* to 6*h* are schematic front views of the G2 electrode of the in-line type electron gun of the color cathode ray tube of this invention as seen from the G3 electrode side.
Figure 6G:
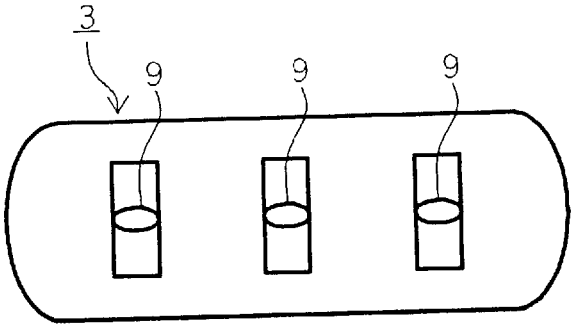
Figure 6H:
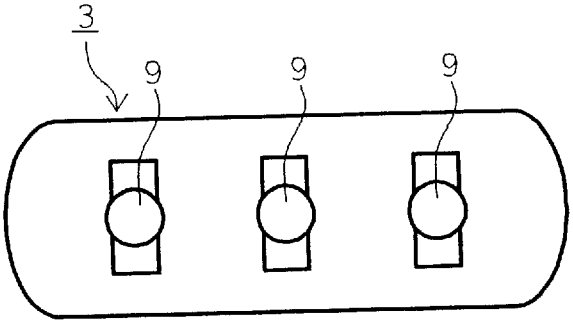
Figure 7A:
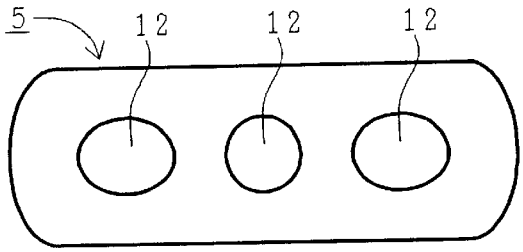
FIGS. 7*a* to 7*f* are schematic front views of the G4 electrode of the in-line type electron gun of the color cathode ray tube of this invention.
Figure 7B:
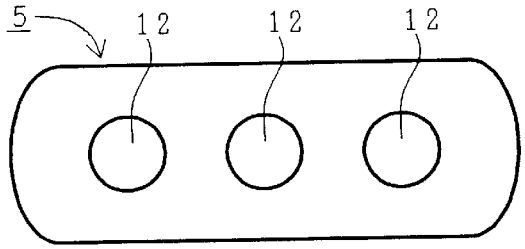
Figure 7C:
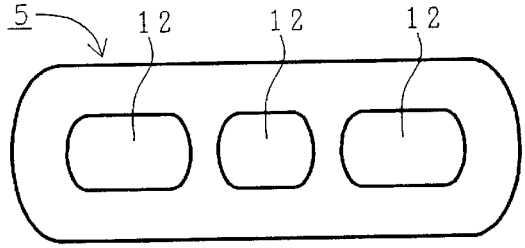
Figure 7D:
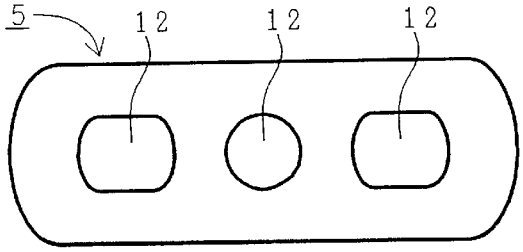
Figure 7E:
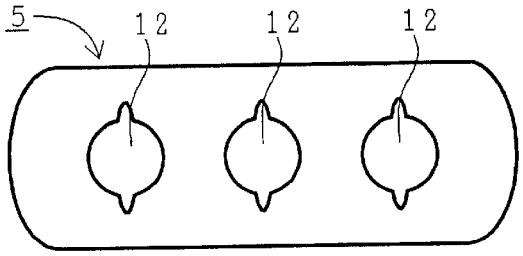
Figure 7F:
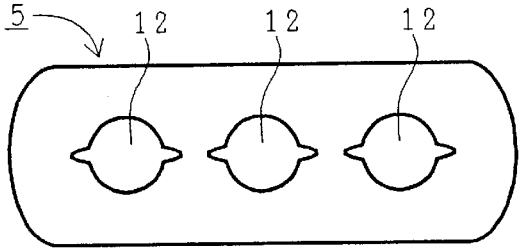

FIGS. 6*a* to 6*h* show the rear and front views of the G2 electrode 3 that can be applied to the electron gun of FIG. 4. FIGS. 6*a* to 6*e* show the shapes of apertures 9 in the G2 electrode as seen from the G1 electrode side. FIGS. 6*f* to 6*h* show the shapes of apertures 9 in the G2 electrode as seen from the G3 electrode side. As shown in FIGS. 6*a* to 6*h,* the apertures 9 in the G2 electrode may be provided with a rectangular recess. The shape of the apertures 9 in the G: electrode may be a circle, square or oval. The three electron beam apertures 9 in the G2 electrode 3 may all have the same shape or the center beam aperture and the side beam apertures may be differentiated in shape.

FIGS. 7*a* to 7*f* show the rear views of the G4 electrode 5 that can be applied to the electron gun of FIG. 4. FIGS. 7*a* to 7*f* show the shapes of apertures 12 in the G4 electrode as seen from the G3 electrode side. The apertures 12' in the G4 electrode on the G5 electrode side have the same shape as the opposing apertures 12. The shape of the apertures 12, 12' in the G4 electrode 5 may be a circle or oval, or a combination of these. The three electron beam apertures 12, 12' in the G4 electrode may all have the same shape or the center beam aperture and the side beam apertures may be different in shape.

Figure 8A:
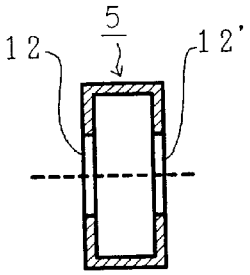
FIGS. 8*a* to 8*i* are schematic cross sections of the G4 electrode in the in-line type electron gun of the color cathode ray tube of this invention.
Figure 8B:
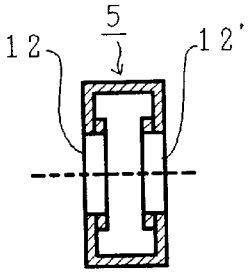
Figure 8C:
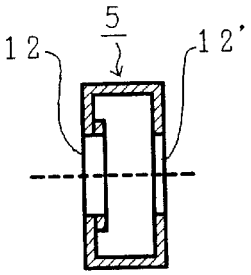
Figure 8D:
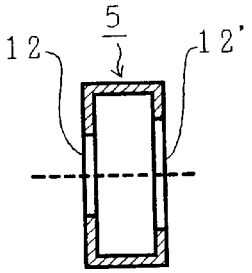
Figure 8E:
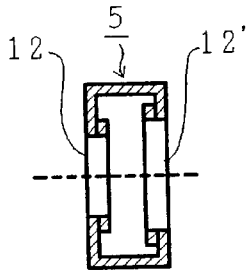
Figure 8F:
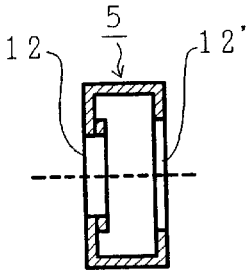
Figure 8G:
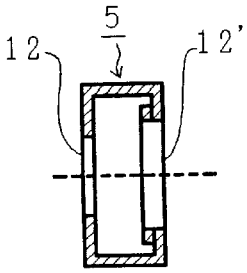
Figure 8H:
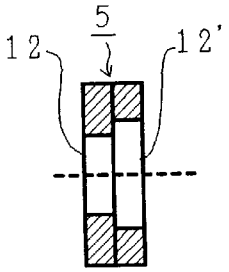
Figure 8I:
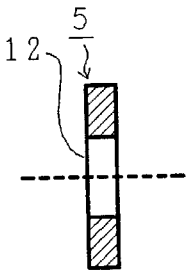

FIGS. 8*a* to 8*i* show schematic cross sections of the G4 electrode 5 that can be applied to the electron gun of FIG. 4. The G4 electrode 5 may be formed as a box as shown in FIGS. 8*a* to 8*g*. or two plates bonded together as shown in FIG. 8*h,* or a single flat plate as shown in FIG. 8*i*. The size relation between the G4 electrode aperture 12 on the G3 electrode side and the G4 electrode aperture 12' on the G5 electrode side may be opposite to those shown in FIGS. 8*a* to 8*h*.

Now, the embodiments of the present invention will be described in detail by referring to the drawings.

(Embodiment 1)

The electron gun of FIG. 4 was incorporated in a color display tube (CDT) with an effective diagonal screen size of 51 cm and a shadow mask pitch of 0.25 mm. In FIG. 4, the diameter of the G1 electrode apertures 8 is 0.35 mm, the diameter of the G2 electrode apertures 9 is 0.42 mm, the G2 electrode length in the tube axis direction is 0.4 mm, and the G2 electrode apertures on the G3 electrode side are provided with a laterally elongate rectangular recess. The diameters of the G3 electrode apertures 11 on the G4 electrode side, the G4 electrode apertures 12 on the G3 electrode side, the G4 electrode apertures 12' on the G5 electrode side, and the G5 electrode apertures 13 on the G4 electrode side are set at 4.0 mm. The lengths of the G4 electrode 5 and the G5 electrode 6 are set at 0.5 mm and 27 mm, respectively. In this embodiment, the ratio A of the G2 electrode length to the G2 electrode aperture diameter is 0.95 and the ratio B of the G4 electrode length to the G4 aperture diameter (diameter of the sub-main lens) is 0.125, both in the shaded range of FIG. 3.

This embodiment produces the following beam spot diameters in a high current range. That is, the beam spot diameter is 0.57 mm and 0.70 mm for the cathode current of 300 $\mu$A and 500 $\mu$A, respectively. In the low current range, this embodiment produces a beam spot diameter of 0.45 mm for a cathode current of 100 $\mu$A. Almost no moire was observed on the screen. With this embodiment, therefore, it is possible to provide a color cathode ray tube having an in-line type electron gun that satisfies both requirements of improving the focusing characteristic in the high current range and suppressing moire in the low current range.

(Embodiment 2)

The electron gun of FIG. 4 was incorporated in a CDT with an effective diagonal screen size of 51 cm and a shadow mask pitch of 0.28 mm. In FIG. 4, the diameter of the G1 electrode apertures 8 is 0.30 mm, the diameter of the G2 electrode apertures 9 is 0.35 mm, the G2 electrode length in the tube axis direction is 0.3 mm, and the G2 electrode apertures on the G3 electrode side are provided with a laterally elongate rectangular recess. The diameters of the G3 electrode apertures 11 on the G4 electrode side, the G4 electrode apertures 12, and the G5 electrode apertures 13 on the G4 electrode side are set at 4.0 mm. The lengths of the G4 electrode 5 and the G5 electrode 6 are set at 0.8 mm and 27 mm, respectively.

In this embodiment, the ratio A of the G: electrode length to the G2 electrode aperture diameter is 0.86 and the ratio B of the G4 electrode length to the G4 aperture diameter (diameter of the sub-main lens) is 0.2, both in the shaded range of FIG. 3.

In the high current range, this embodiment produces beam spot diameters of 0.57 mm and 0.70 mm for cathode currents of 300 $\mu$A and 500 $\mu$A, respectively. In the low current range, this embodiment produces a beam spot diameter of 0.45 mm for a cathode current of 100 $\mu$A. In this embodiment, almost no moire was observed on the screen.

(Embodiment 3)

The electron gun of FIG. 4 was incorporated in a CDT with an effective diagonal screen size of 51 cm and a shadow mask pitch of 0.25 mm. In FIG. 4, the diameter of the G1 electrode apertures 8 is 0.40 mm, the diameter of the G2 electrode apertures 9 is 0.5 mm, the G2 electrode length in the tube axis direction is 0.45 mm, and the G2 electrode apertures on the G3 electrode side are provided with a laterally elongate rectangular recess. The diameters of the G3 electrode apertures 11 on the G4 electrode side, the G4 electrode apertures 12, and the G5 electrode apertures 13 on the G4 electrode side are set at 4 mm. The lengths of the G4 electrode 5 and the G5 electrode 6 are set at 0.6 mm and 27 mm, respectively.

In this embodiment, the ratio A of the G2 electrode length to the G2 electrode aperture diameter is 0.9 and the ratio B of the G4 electrode length to the G4 aperture diameter (diameter of the sub-main lens) is 0.15. Both of these ratios fall in the shaded range of FIG. 3.

In the high current range, this embodiment produces the beam spot diameters of 0.57 mm and 0.70 mm for cathode currents of 300 $\mu$A and 500 $\mu$A, respectively. In the low current range, this embodiment produces a beam spot diameter of 0.45 mm for a cathode current of 100 $\mu$A. In this embodiment, almost no moire was observed on the screen.

(Embodiment 4)

Figure 9:
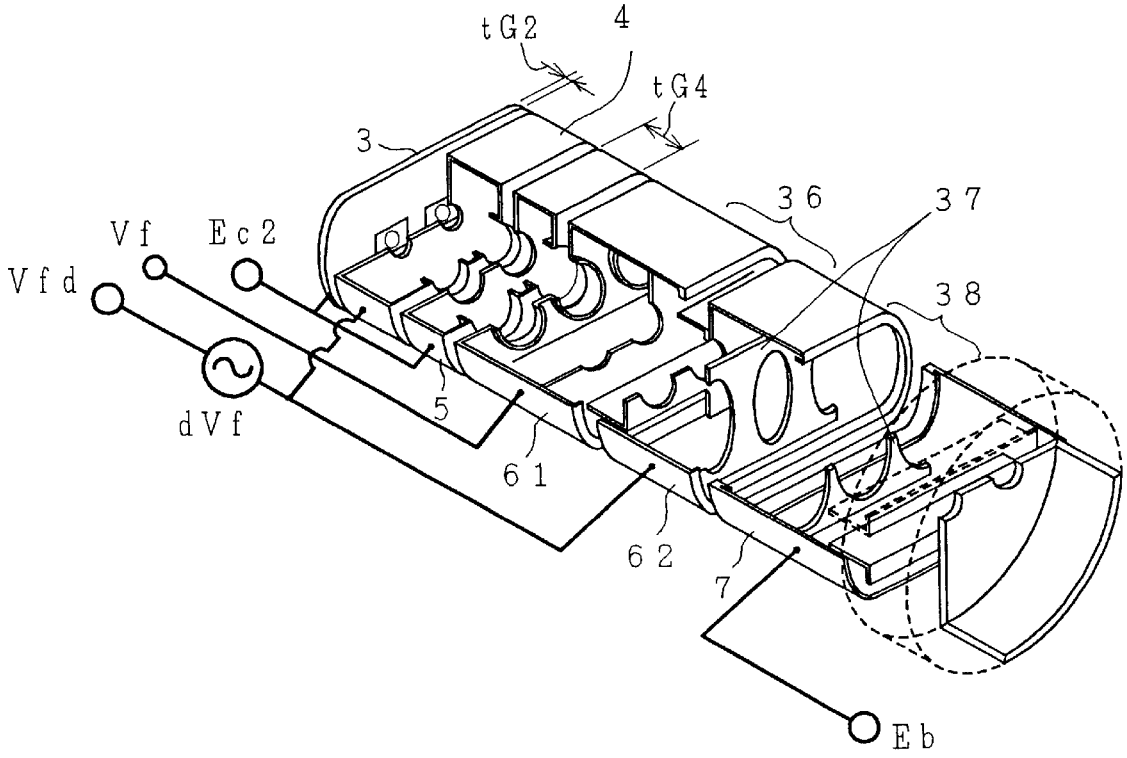
FIG. 9 is a schematic, cutaway, perspective view showing the construction of an embodiment of the in-line type electron gun used in the color cathode ray tube according to this invention.

The electron gun outlined in FIG. 9 was incorporated in a CDT with an effective diagonal screen size of 46 cm and a shadow mask pitch of 0.26 mm. In FIG. 9, a G5 electrode 6 is divided into a G5-1 electrode 61 and a G5-2 electrode 62 to form a quadrupole lens 36 between the G5-1 electrode 61 and the G5-2 electrode 52. In this embodiment, a main lens 38 is formed between a G6 electrode 7 and the G5-2 electrode 62. The opposing G6 electrode 7 and G5-2 electrode 62 are cylindrical electrodes, both of which incorporate plate electrodes 37 that have a vertically elongate oval opening for passing the electron beams. These openings in the cylindrical electrodes form a single common path for the three electron beams. The single common path of these cylindrical electrodes is roughly oval in cross section. In FIG. 9, the G3 electrode 4 and the G5-2 electrode 62 are supplied with a current that flows in the deflection yoke, i.e., a dynamic focus voltage dVf that varies in synchronism with the electron beam deflection.

The dynamic focus voltage dVf may be applied only to the G5-2 electrode 62. In that case, the G3 electrode 4 is at a constant voltage Vf, the same potential as the G5-1 electrode 61.

In FIG. 9, the diameters of the G1 electrode apertures 8 and G2 electrode apertures 9 were set at 0.37 mm and 0.55 mm, respectively, and the G2 electrode length was set at 0.55 mm. The G2 electrode apertures on the G3 electrode side were provided with a laterally elongate recess. The diameters of the G3 electrode apertures 11 on the G4 electrode side, the G4 electrode apertures 12, and the G5 electrode apertures 13 on the G4 electrode side were set at 4 mm. The lengths of the G4 electrode 5 and the G5 electrode 6 were set at 0.6 mm and 27 mm, respectively.

In this embodiment, the ratio A of the G2 electrode length to the G2 electrode aperture diameter is 1 and the ratio B of the G4 electrode length to the G4 aperture diameter (diameter of the sub-main lens) is 0.15. Both of these ratios fall in the shaded range of FIG. 3.

In the high current range, this embodiment produces beam spot diameters of 0.57 mm and 0.70 mm for cathode currents of 300 $\mu$A and 500 $\mu$A, respectively. In the low current range, this embodiment produces a beam spot diameter of 0.45 mm for a cathode current of 100 $\mu$A. In this embodiment, almost no moire was observed on the screen.

(Embodiment 5)

The electron gun of FIG. 4 was incorporated in a CDT with an effective diagonal screen size of 51 cm and a shadow mask pitch of 0.25 mm. In FIG. 4, the diameter of the G1 electrode apertures 8 was set at 0.35 mm, the diameter of the G2 electrode apertures 9 was set at 0.36 mm, and the G2 electrode length was set at 0.38 mm. The G2 electrode apertures on the G3 electrode side were provided with a laterally elongate rectangular recess. The diameters of the G3 electrode apertures 11 on the G4 electrode side, the G4 electrode apertures 12, and the G5 electrode apertures 13 on the G4 electrode side were set at 4 mm. The lengths of the G4 electrode 5 and the G5 electrode 6 were set at 0.6 mm and 27 mm, respectively.

In this embodiment, the ratio A of the G2 electrode length to the G2 electrode aperture diameter is 1.05 and the ratio B of the G4 electrode length to the G4 aperture diameter (diameter of the sub-main lens) is 0.15. Both of these ratios fall in the shaded range of FIG. 3.

In the high current range, this embodiment produces the beam spot diameters of 0.57 mm and 0.70 mm for cathode currents of 300 $\mu$A and 500 $\mu$A, respectively. In the low current range, this embodiment produces a beam spot diameter of 0.45 mm for a cathode current of 100 $\mu$A. In this embodiment, almost no moire was observed on the screen.

What is claimed is:

1. A color cathode ray tube having an in-line type electron gun comprising:

electron beam generating means including at least a cathode for producing three electron beams directed toward a phosphor screen, a first electrode and a second electrode, both constituting control electrodes and arranged in that order, and a heater for heating the cathode;

a third electrode, a fourth electrode and a fifth electrode, together constituting a sub-main lens for focusing the three electron beams onto the phosphor screen; and a fifth electrode and a sixth electrode, both forming a main lens;

wherein electrical connections are made between the second electrode and the fourth electrode and between the third electrode and the fifth electrode;

wherein the first electrode has an aperture of 0.45 mm or smaller in diameter and the relation between a ratio A of the second electrode length in the tube axis direction to a second electrode aperture diameter and a ratio B of the fourth electrode length in the tube axis direction to a fourth electrode aperture diameter is in a region enclosed by four lines represented by $40A+88B-57=0$ $100A-260B-22=0$ $100A+176B-112=0$ $B-0.125=0$.

2. A color cathode ray tube according to claim 1, wherein the fifth electrode and the sixth electrode forming the main lens of the in-line type electron gun are cylindrical electrodes having openings approximately oval in cross section and the cylindrical electrodes contain therein plate electrodes having electron beam passing openings.

3. A color cathode ray tube according to claim 2, wherein the openings of the fifth electrode and the sixth electrode are on a single common path for three electron beams.

4. A color cathode ray tube according to claim 1, wherein the fifth electrode is divided into a plurality of parts, to one of which is applied a voltage that is synchronous with a current flowing in a deflection yoke.

5. A color cathode ray tube according to claim 1, wherein the first electrode has an aperture 0.37 mm or smaller in diameter.

6. A color cathode ray tube according to claim 1, wherein the first electrode has an aperture of 0.35 mm or smaller in diameter.

7. A color cathode ray tube having an in-line type electron gun comprising:

electron beam generating means including at least a cathode for producing three electron beams, red, green and blue beams, directed toward a phosphor screen, a first electrode and a second electrode, both constituting control electrodes and arranged in that order, and a heater for heating the cathode;

a third electrode, a fourth electrode and a fifth electrode, together constituting a sub-main lens for focusing the three electron beams onto phosphor screen; and a fifth electrode and a sixth electrode, both forming a main lens;

wherein the electrical connections are made between the second electrode and the fourth electrode and between the third electrode and the fifth electrode;

wherein the first electrode has an aperture of 0.45 mm or smaller in diameter through which a green electron beam passes, and the relation between a ratio A of the second electrode length in the tube axis direction to the diameter of a second electrode aperture for the green electron beam and a ratio B of the fourth electrode length in the tube axis direction to the diameter of a fourth electrode aperture for the green electron beam is in a region enclosed by four lines represented by $40A+88B-57=0$ $100A-260B-22=0$ $100A+176B-112=0$ $B-0.125=0$.

8. A color cathode ray tube according to claim 7, wherein the fifth electrode and the sixth electrode forming the main lens of the in-line type electron gun are cylindrical electrodes having openings approximately oval in cross section and the cylindrical electrodes contain therein plate electrodes having electron beam passing openings.

9. A color cathode ray tube according to claim 8, wherein the openings of the fifth electrode and the sixth electrode are on a single common path for three electron beams.

10. A color cathode ray tube according to claim 7, wherein the fifth electrode is divided into a plurality of parts, to one of which is applied a voltage that is synchronous with a current flowing in a deflection yoke.

11. A color cathode ray tube according to claim 7, wherein the first electrode has an aperture of 0.37 mm or smaller in diameter.

12. A color cathode ray tube according to claim 7, wherein the first electrode has an aperture of 0.35 mm or smaller in diameter.

* * * * *